US007243808B2

(12) United States Patent
Livingston et al.

(10) Patent No.: US 7,243,808 B2
(45) Date of Patent: Jul. 17, 2007

(54) PLASTIC CONTAINER WITH HORIZONTALLY ORIENTED PANELS

(75) Inventors: John J. Livingston, Denver, CO (US); Erik E. Gatewood, Lafayette, CO (US); Brian D. Tyree, Thornton, CO (US)

(73) Assignee: Ball Corporation, Broomfield, CO (US)

( * ) Notice: Subject to any disclaimer, the term of this patent is extended or adjusted under 35 U.S.C. 154(b) by 217 days.

(21) Appl. No.: 11/035,790

(22) Filed: Jan. 14, 2005

(65) Prior Publication Data

US 2006/0157438 A1 Jul. 20, 2006

(51) Int. Cl.
*B65D 1/02* (2006.01)
*B65D 1/46* (2006.01)

(52) U.S. Cl. ..... 215/381; 215/382; 215/900; 220/666; 220/669; 220/575

(58) Field of Classification Search ..... 215/381–384, 215/900; 220/669, 675, 666, 671
See application file for complete search history.

(56) References Cited

U.S. PATENT DOCUMENTS

| | | | | |
|---|---|---|---|---|
| 5,054,632 | A | | 10/1991 | Alberghini et al. |
| 5,178,289 | A | | 1/1993 | Krishnakumar et al. |
| 5,261,543 | A | * | 11/1993 | Ugarelli ..... 215/375 |
| 5,279,433 | A | | 1/1994 | Krishnakumar et al. |
| 5,690,244 | A | | 11/1997 | Darr |
| 6,550,627 | B2 | | 4/2003 | Elich et al. |
| 6,575,320 | B2 | | 6/2003 | Ota et al. |
| 6,827,228 | B2 | | 12/2004 | Headen et al. |
| 6,837,390 | B2 | | 1/2005 | Lane et al. |
| D502,108 | S | | 2/2005 | Gamel et al. |
| D502,109 | S | | 2/2005 | Hutter et al. |
| 6,857,531 | B2 | | 2/2005 | Slat et al. |
| D502,403 | S | | 3/2005 | Chirico |
| D502,877 | S | | 3/2005 | Stockwell et al. |
| D507,489 | S | | 7/2005 | Chirico |
| 6,920,992 | B2 | | 7/2005 | Lane et al. |
| D508,854 | S | | 8/2005 | Livingston |
| 6,923,334 | B2 | | 8/2005 | Melrose et al. |
| 6,929,138 | B2 | | 8/2005 | Melrose et al. |
| 6,932,230 | B2 | | 8/2005 | Pedmo et al. |
| 6,935,525 | B2 | | 8/2005 | Trude |
| D509,143 | S | | 9/2005 | Slat et al. |
| D509,145 | S | | 9/2005 | Dorn et al. |

(Continued)

FOREIGN PATENT DOCUMENTS

| | | |
|---|---|---|
| GB | 2 161 133 A | 1/1986 |

*Primary Examiner*—Sue A. Weaver
(74) *Attorney, Agent, or Firm*—Brinks Hofer Gilson & Lione

(57) ABSTRACT

A molded polymeric container generally symmetric about a vertical axis includes at least two rows of panels disposed circumferentially around the body, the panels having central portions that are sufficiently flexible to be dimensionally responsive to changes in pressure within the container. At least one row of the panels has a margin having a horizontal width exceeding the vertical height, thus being laterally elongate with a height/width aspect ratio of less than one. The pressure responsive central portion of each laterally elongate panel is a smooth outwardly projecting dome from a peripheral root of a generally radially projecting wall defining the margins of circumferential rings and posts separating the panels. The outwardly projection domes of the laterally elongate panels can have a variety of shapes.

20 Claims, 6 Drawing Sheets

U.S. PATENT DOCUMENTS

| | | | | |
|---|---|---|---|---|
| D510,031 | S | 9/2005 | Slat et al. | |
| 6,938,788 | B2 | 9/2005 | White | |
| 7,014,056 | B2 * | 3/2006 | Trude | 215/381 |
| 2001/0027978 | A1 | 10/2001 | Finlay et al. | |
| 2001/0030167 | A1 | 10/2001 | Mooney | |
| 2002/0104820 | A1 | 8/2002 | Hong et al. | |
| 2003/0000911 | A1 | 1/2003 | Kelley et al. | |
| 2003/0000912 | A1 | 1/2003 | Deubel et al. | |
| 2004/0000533 | A1 | 1/2004 | Kamineni et al. | |
| 2004/0016716 | A1 | 1/2004 | Melrose et al. | |
| 2004/0074864 | A1 | 4/2004 | Melrose et al. | |
| 2004/0195199 | A1 * | 10/2004 | Maki et al. | 215/381 |
| 2005/0051509 | A1 | 3/2005 | Bysick et al. | |
| 2005/0218108 | A1 | 10/2005 | Bangi et al. | |

* cited by examiner

PLASTIC CONTAINER WITH HORIZONTALLY ORIENTED PANELS

BACKGROUND

1. Technical Field

The present invention is directed to molded plastic bottles capable of being filled with liquids at elevated temperature. The present invention is particularly directed to such containers having at least two vertically spaced circumferential rows of pressure or vacuum responsive panels.

The present invention particularly relates to blow-molded containers of biaxially oriented thermoplastic materials such as polyethylene terephthalate that are designed to be filled with a hot liquid or semi-liquid product and hermetically sealed, generally referred to as thin-walled, hot-fill containers. The invention pertains to improvements in the design of such containers intended to achieve a container side wall construction that provides enhanced support during filing and subsequent handling and, despite the low weight of polymer used to form the container, retains the desired container configuration despite the development of a partial vacuum within the container when capped and cooled.

2. General Background

It is well recognized that the exposure of any plastic container to elevated temperatures tends to soften the plastic material and make the container less resistant to deformation. It is also well known to thermally treat some plastic containers during manufacturing so that this tendency is diminished to the point that the containers do not deform when hot-filled. Such thin-walled, hot-fill containers are typically used for packaging beverages and other food products that must be placed in the container while hot, the containers being quickly capped to preserve the quality of the contents. During the filling process, the container and head space gasses are subjected to temperatures from the hot product. The container is capped container is then cooled at least to ambient temperature, and perhaps refrigerated, which causes the liquid contents and any head space gases to contract. This is reflected in a drop in internal pressure, or the development of an internal vacuum within the container, which can deform the container. It is well known to compensate for the temperature induced pressure change by providing the container with a plurality of panels having sufficient flexibility and/or elasticity to permit a change in container volume that will at least partially compensate for the pressure changes.

Alberghini et al. U.S. Pat. No. 5,054,632 discloses a container that is intended to be hot-filled including at least two circumferential rows of essentially square panels providing controlled volumetric reduction of the container. A land or post separates each adjacent pair of panels in each row. The rows of panels are staggered with respect to each other such that the lands or posts of one row are vertically aligned with the center of the panels of any adjacent row. The design is said to distribute circumferentially the vertical and horizontal support for any label applied to the label panel of the container while still providing the desired panel movement in response to the existence of a partial vacuum within the container due to hot filling.

Krishnakumar et al. U.S. Pat. Nos. 5,178,289 and 5,279,433 disclose hot-fill containers having a plurality of vertically elongated vacuum panel regions that are symmetrically disposed about a horizontal centerline of the container label panel. They also disclose hot-fill containers having a plurality of vertically paired, generally square vacuum panel regions that are symmetrically disposed about a horizontal centerline of the container label panel. Vertical stiffening ribs are provided between horizontally adjacent vacuum panel recesses or pairs. Additional vertical stiffening ribs are provided in the center of islands or spot label areas within the pairs of vacuum panel regions. The angular extent of the vacuum panel regions and spot label areas is said to be variable to adjust the resistance to barreling and/or to provide a squeezable container.

Darr U.S. Pat. No. 5,690,244 discloses a unitary plastic bottle having a central axis, an upper dispensing end, a lower freestanding base, and a generally round side wall having upper and lower extremities respectively connected to the upper dispensing end and the lower freestanding base. The side wall of the container has at least three vertically spaced horizontal ribs of an annular shape extending around the container. The side wall also has at least twelve vertical ribs spaced circumferentially and extending between the horizontal ribs and cooperating therewith to define at least twelve essentially square panels spaced around the container between each adjacent pair of horizontal ribs, and the panels being capable of flexing inwardly to accommodate for shrinkage upon cooling after hot filling of the container.

Ota et al U.S. Pat. No. 6,575,320 discloses a container suitable for hot-fill use with a body having a pair of body portions that are arranged in a longitudinal direction of the body one above the other. Each body portion has a substantially regular polygonal cross-section defined by a plurality of generally flat walls. The generally flat walls of each of the body portions include flexible walls and less-flexible walls, which are arranged alternately to each other in a circumferential direction of the body. When the container is filled with liquid contents at a high temperature and subsequently cooled to room temperature, a resultant pressure drop within the container is absorbed by the walls, initially by a primary inward deflection of the flexible walls and subsequently by a secondary inward deflection of the less-flexible walls Despite the variations disclosed in the prior art, there is a continuing need for an improved molded plastic container having a side wall that exhibits outstanding dimensional stability under the typical conditions experienced during and subsequent to hot-fill and capping. In particular there is a continuing need for such a container that will provide sufficient side wall stability and support to inhibit buckling in the event of side wall impact and will provide a more stable feel to the user of the container.

BRIEF SUMMARY

A molded polymeric container of the present invention satisfies such needs by providing a unitary one-piece plastic container having a body that is generally symmetric about a vertical axis. The body includes at least two rows of panels disposed circumferentially around the body, the panels having central portions that are sufficiently flexible to be dimensionally responsive to changes in pressure within the container. At least one row of the panels has a horizontal width exceeding the vertical height, thus being laterally elongate and having a height/width aspect ratio of less than one. The laterally elongate panels can have a perimeter that is generally rectangular, ellipsoidal, or otherwise elongated in the horizontal direction. The pressure responsive central portion of each laterally elongate panel can be a smooth outwardly projecting dome having a variety of shapes. The edges of the dome can be at the root of a generally radially projecting wall defining the margins of the panel.

Adjacent rows of panels can be separated from each other by a circumferential ring element of the body side wall joined smoothly to the generally radial projecting walls defining the upper and lower margins of the panels in the adjacent rows. Adjacent panels of each row can be separated from each other by generally vertical posts or lands that have outer surfaces continuous at least at one end with a circumferential ring element. The posts separating the laterally elongate panels in one row can be aligned with the centers of the panels in an adjacent row to achieve a staggered alignment of panels. The side wall of a container can include rows of pressure responsive panels all of which are exclusively laterally elongate. Alternatively, the laterally elongated pressure responsive panels can be included as only a single row adjacent at least one other row of panels having a height/width aspect ratio of at least one.

The side wall configuration achieved by the incorporation of the laterally elongate pressure responsive panels exhibits exceptionally stable geometry from manufacture through typical hot-fill conditions and subsequent storage despite the use of a modest amount of polymer to form the container. The scope of the containers that can be constructed with side wall of the present invention will become more apparent from the following description and accompanying drawings detailing illustrative examples of the present invention. The components in the figures are not necessarily to scale, emphasis instead being placed upon illustrating the principles of the invention. Moreover, in the figures, like referenced numerals designate corresponding parts throughout the different views.

DESCRIPTION OF THE PREFERRED EMBODIMENTS

Figure 1:
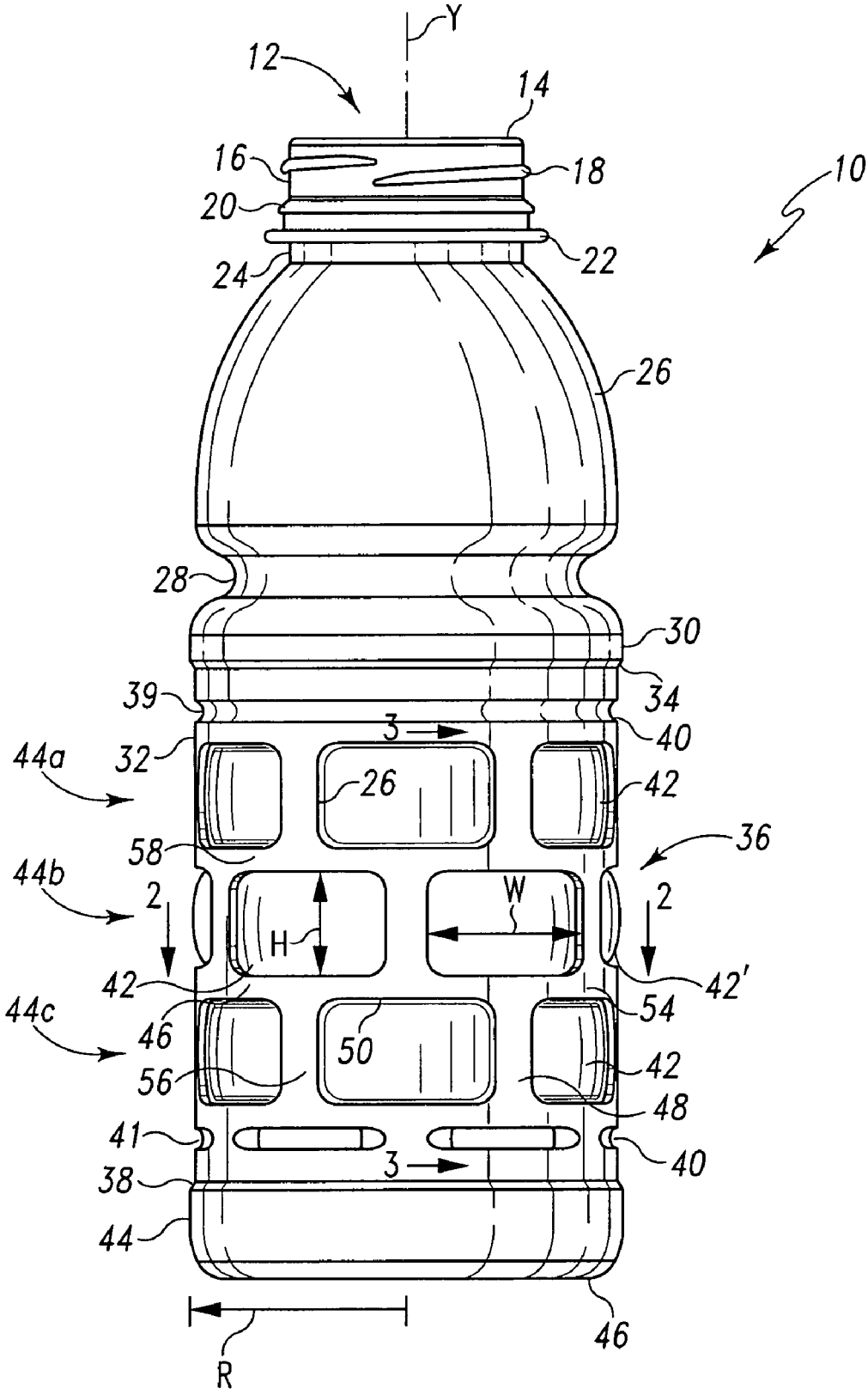
FIG. 1 is a side elevation view of a molded polymeric container of the present invention including a plurality of rows of laterally elongated pressure responsive panels.

A container 10 of the present invention is shown in FIG. 1 to be generally symmetric about a vertical axis Y, and has an open mouth 12 surrounded by a lip 14 intended to cooperate with a cap, not shown, to seal the container and contents. A cap-engaging finish 16 is located below the lip 14, which is illustrated to have the form of a spiral thread 18. The particular form of the finish 16 can be varied to include a range of thread styles or even be replaced with any number of non-threaded finishes designed to accept a crown type or other cap. A pilfer ring 20 can be located immediately below the finish 16 to engage a pilfer-indicating band of a cap. A support ring 22 can be provided below the pilfer ring 20 that facilitates handling of the container 10 as well as the handling of the parison or preform from which the container 10 is formed. A neck portion 24 is located immediately below the support ring.

A shoulder portion 26 extends outward and downward from a lower margin of the neck portion 24. The shoulder portion 26 can include an indented hoop ring 28 to provide added strength to the container 10. A bumper ring 30 can be provided at a lower margin of the shoulder portion 26 that can define the maximum radius R of the container sidewall 32 measured from the axis Y. A lower margin of the bumper ring 30 can also define the upper margin 34 of a label receiving portion 36 that is intended to receive a separate label, not shown. The label can be a sheet of plastic, paper, or other similar material of suitable dimension that can surround the entire sidewall 32 of the container 10. The label typically covers the container 10 from the upper margin 34 down to the lower margin 38 of the label receiving portion 36. The label receiving portion 36 can also include one or more reinforcing hoop rings 40. The hoop rings 40 can be circumferentially continuous such as upper hoop ring 39 or can be discontinuous such as lower hoop ring 41. A plurality of vacuum compensation panels 42 can also be provided within the label receiving portion 36 of the sidewall 32. A convex heal portion 44 extends downward from the container sidewall 32 generally to an annular contact ring 46 that supports the container 10 with respect to any underlying surface. The annular contact ring 46 can include or be replaced by a plurality of downward projections, not shown, forming discrete feet upon which the container 10 can stand upon any underlying surface.

Figure 2:
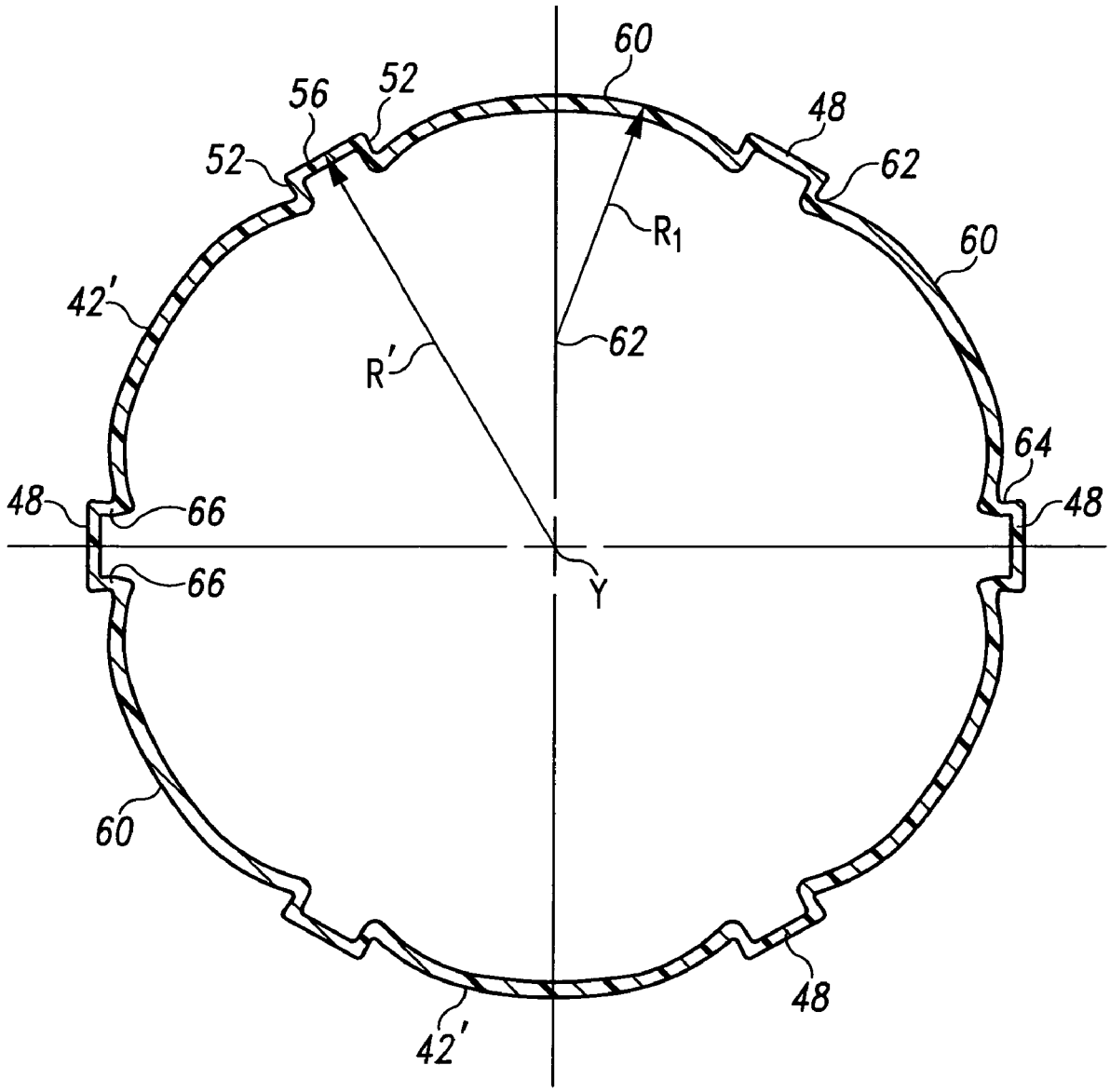
FIG. 2 is a sectional view taken along line 2-2 in FIG. 1.

The vacuum compensation panels 42 are arranged in a plurality of circumferential rows 44*a*, 44*b*, 44*c*, etc. At least one of the rows 44 contains vacuum compensation panels 42' that have a horizontal width W that exceeds the vertical height H so that the panels 42' appear to be laterally elongated as shown in FIG. 1. While the panels 42' appear in FIG. 1 as generally rectangular, it will be appreciated that other laterally elongated shapes are possible such as elliptical. A circumferential ring element 46 separates each adjacent pair of circumferential rows 44 of panels 42. Vertical posts 48 separate adjacent panels 42 within each row 44. Edges 50 and 52 of the circumferential ring elements 46 and vertical posts 48 can respectively define the vertical and horizontal margins of the vacuum compensation panels 42. The outermost surfaces 54 and 56 of the circumferential ring elements 46 and vertical posts 48, respectively, can form a smoothly continuous cylindrical surface 58 situated at radius R' from the Y axis as shown in FIG. 2, which is a horizontal cross-section of the container 10. R' is generally only slightly smaller than R.

The vacuum compensation panels 42' can be seen in horizontal cross-section in FIG. 2 to have a smooth outwardly projecting dome 60, which can be defined by a radius line $R_1$ having a center of radius 62 situated between the axis Y and the cylindrical surface 58. The edges 64 of the dome 60 can be at the root of the generally radially projecting wall 66 of the posts 48 defining the lateral margins of the panel 42'. The radius $R_1$ can range considerably in value, from at least about 0.2 to about 2 times the size of the radius R' of the surface 58 of the label receiving portion 36. The variation of the radius $R_1$ can occur within each dome 60 so that the curve as seen in FIG. 2 can be elliptical, oval, or otherwise generally smoothly outwardly bulging as well as circular.

Figure 3:
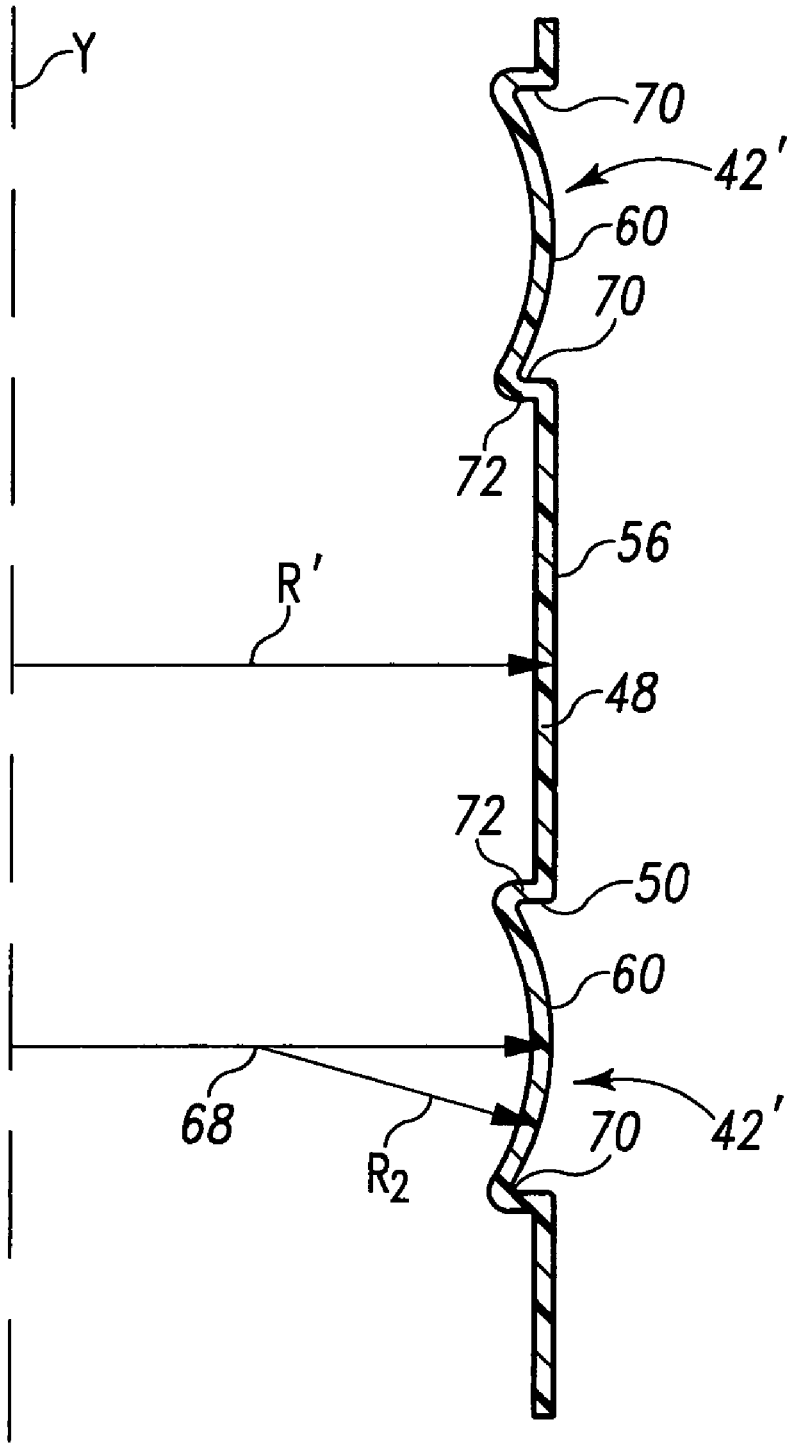
FIG. 3 is a sectional view taken along line 3-3 in FIG. 1.

The smooth outwardly projecting dome 60 of the vacuum compensation panels 42' can also be seen in vertical cross-section in FIG. 3 to be defined by a radius line $R_2$ having a center of radius 68. The radius $R_2$ can also range considerably in value, from at least about 0.2 to about 2 times the size of the radius R' of the surface 58 of the label receiving portion 36. The edges 70 of the dome 60 can be at the root of the generally radially projecting wall 72 of the circumferential ring elements 46 defining the elevational margins of the panel 42'. The radii $R_1$ and $R_2$ need not be of the same size and so the centers of radius 62 and 68 need not be coincident, however they can be. The centers of radius 62 and 68 can be located on a radius line from the Y axis passing through the center of the panel 42'.

Figure 4:
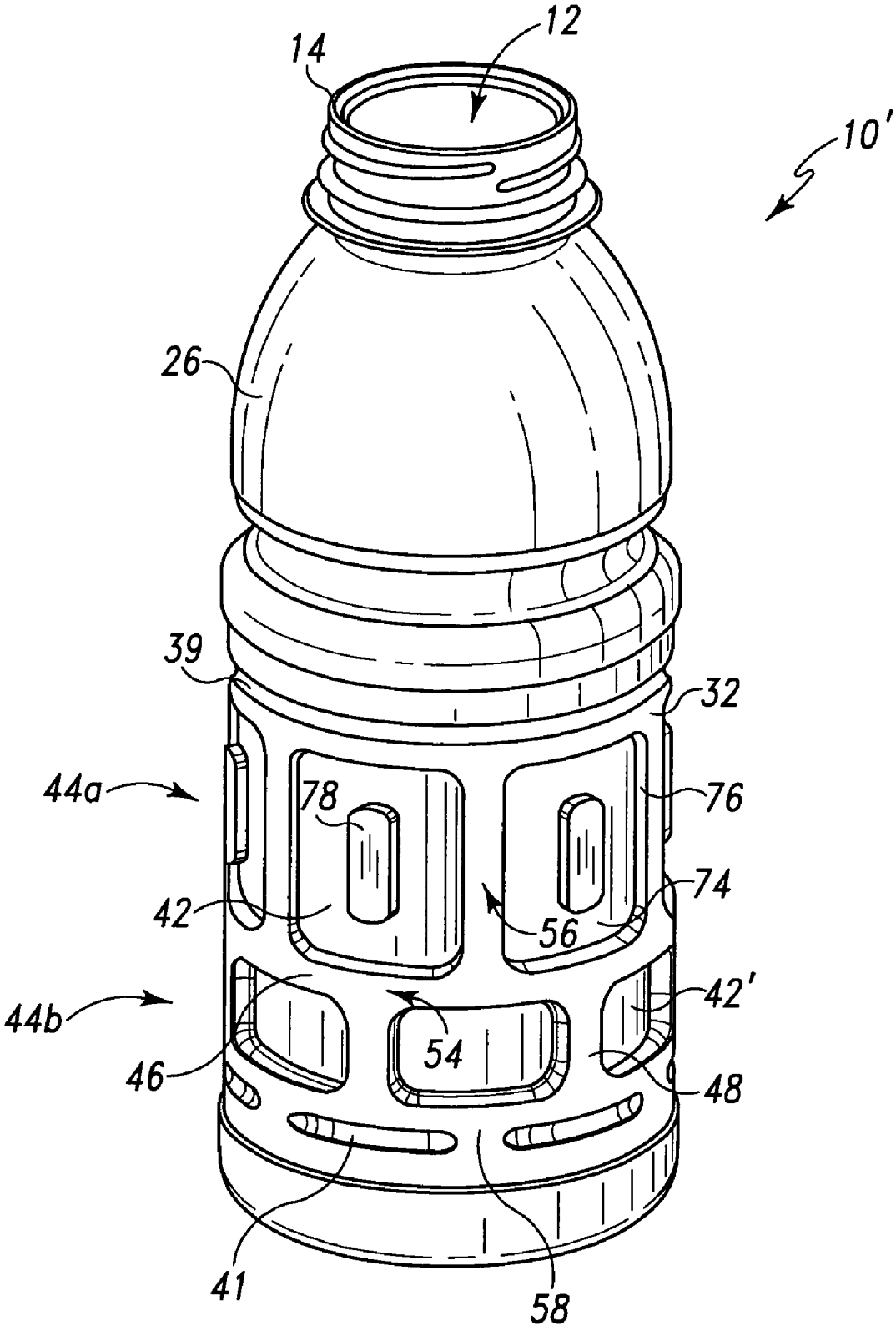
FIG. 4 is a perspective view of another molded polymeric container of the present invention including a plurality of rows of pressure responsive panels, only one of which contains laterally elongated pressure responsive panels.

Another molded polymeric container 10' is shown in FIG. 4 to have many of the features of the previously described container 10 including a side wall 32 that includes a plurality of rows 44 of pressure responsive vacuum compensation panels 42. Only one of the rows 44*b* contains laterally elongated pressure responsive panels 42' of the character described above. The panels 42 in row 44*a* are shown to include a cylindrical wall segment 74 inset with respect to the side wall 32 by a distance determined by the radial dimension of the edge 76. A central island 78 can be provided in the wall segment 74 to provide additional support for any surrounding label. A circumferential ring element 46 separates row 44*a* from row 44*b* while vertical posts 48 separate the panels 42 within each row 44. The vertical posts 48 separating the panels 42' are shown to be vertically aligned with the central island 78 within the wall segment 74 of panel 42. As in FIG. 1, the outermost surfaces 54 and 56 of the circumferential ring elements 46 and vertical posts 48, respectively, can form a smoothly continuous cylindrical surface 58 situated at radius R' from the Y axis.

Figure 5:
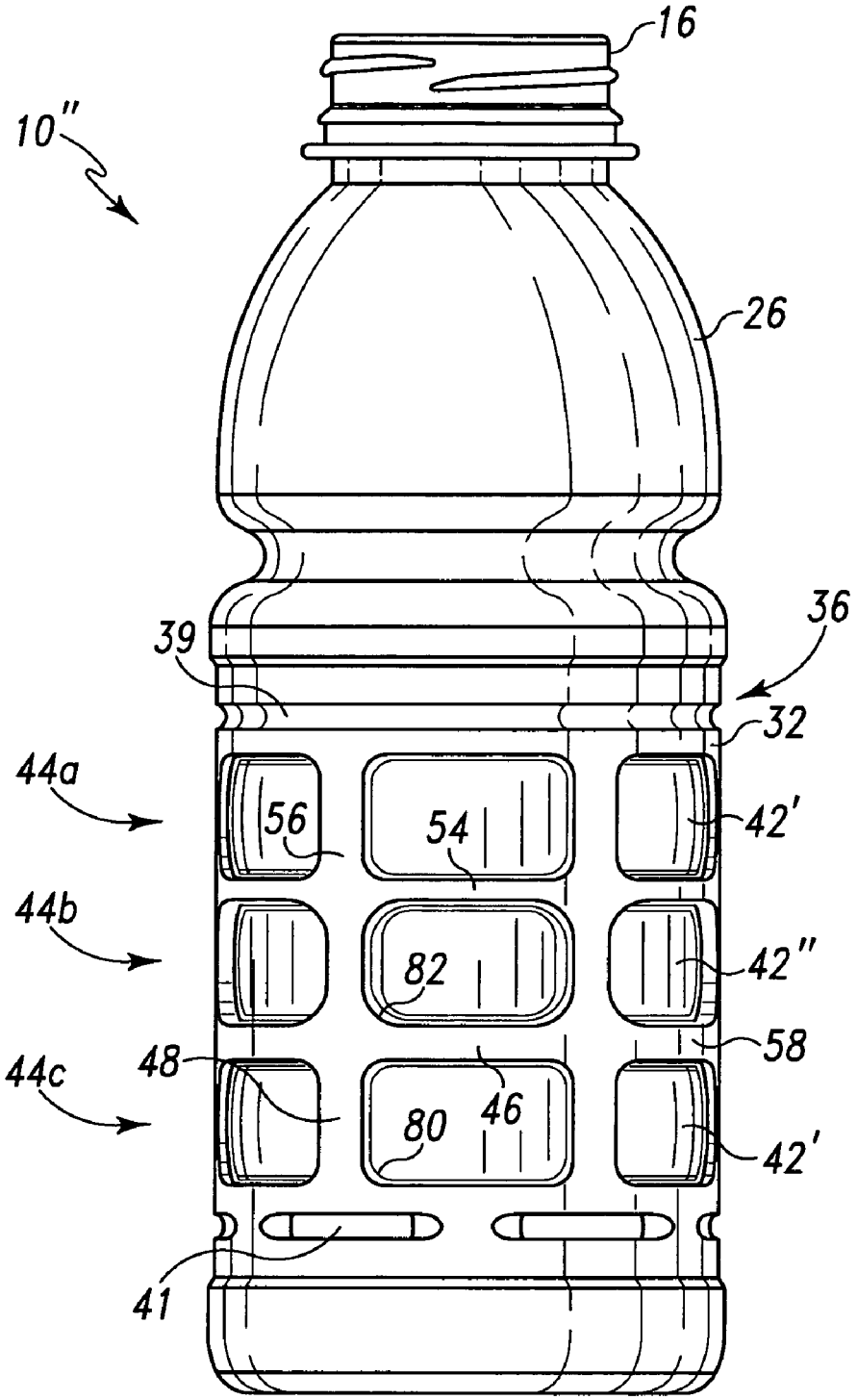
FIG. 5 is a side elevation view of another molded polymeric container of the present invention including a plurality of rows of pressure responsive panels, only one of which contains laterally elongated pressure responsive panels.

Yet another molded polymeric container 10" is shown in FIG. 5 to have many of the features of the previously described containers 10 and 10' including a side wall 32 that includes a plurality of rows 44 of laterally elongated pressure responsive vacuum compensation panels 42' and 42". The panels 42' in rows 44*a* and 44*c* include corners defined by a smaller corner radius 80 while the panels 42" include corners defined by a somewhat larger corner radius 82 so as to appear more elliptical-like with a horizontal axis that is greater in length that the vertical axis. The panels 42' and 42" within each row 44 are separated from each other by vertical posts 48 that extend continuously between the upper hoop ring 39 and the lower hoop ring 41. As in FIGS. 1 and 4, the outermost surfaces 54 and 56 of the circumferential ring elements 46 and vertical posts 48, respectively, can form a smoothly continuous cylindrical surface 58 situated at radius R' from the Y axis.

Figure 6:
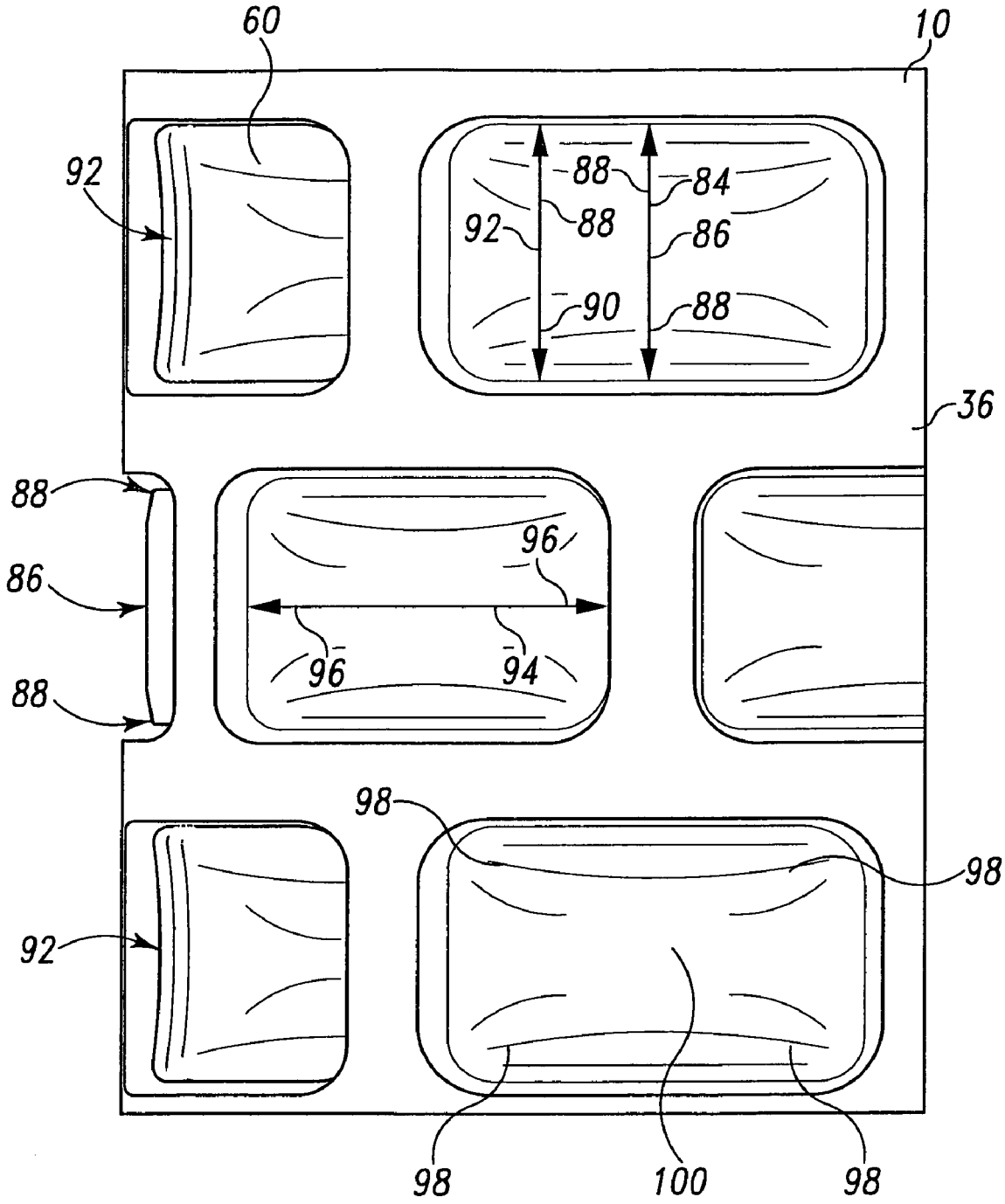
FIG. 6 is a detail side elevation view of a portion of another molded polymeric container of the present invention including a plurality of rows of laterally elongate pressure responsive panels having central domed portions which are generally saddle shaped.

The curves generating the smooth surface of the domes 60 can be even more complex curves generated from a series of radii $R_1$ and $R_2$ rather than merely one or two radii. FIG. 6 is a close-up detail view of a variation of the label receiving portion 36 of the container 10 wherein the domes 60 are formed by a complex series of curves to achieve a generally saddle shape. That is, a vertical mid-line 84 of the domes 60 seen in FIG. 6 has a very large radius, almost linear, central portion 86 blended with a very small radius upper and lower margin 88. A typical vertical section line 90 on either side of the vertical mid-line 84 reveals a large radius but inwardly curving central portion 92 that is blended again to very small radius upper and lower margins 88. A horizontal mid-line 94 of the domes 60 seen in FIG. 6 has a central portion with a radius that is somewhat smaller than radius R' of the surface 58 blended with much smaller radius lateral edges 96. The total appearance of the domes 60 seen in FIG. 6 is one that includes both convex and concave elements, which together appear as four rounded corner protrusions 98 joined together by a smooth saddle shaped surface 100, which can exhibit a wide range of pressure/vacuum compensation characteristics.

The containers 10, 10', and 10" are intended to show but not exhaust the variations in structure that are possible using the laterally elongated pressure responsive vacuum compensation panels 42 of the present invention. The configurations achievable by the incorporation of the laterally elongate pressure responsive panels 42 exhibit exceptionally stable geometry from manufacture through typical hot-fill conditions and subsequent storage despite the use of a modest amount of polymer to form the containers 10. The various side walls 32 provide superior label support, added top load capability, and very favorable handling characteristics even when opened. Thus, the foregoing description the embodiments shown in the Figures should be regarded as merely illustrative rather than limiting, and the following claims, including all equivalents, are intended to define the spirit and scope of this invention.

What is claimed is:

1. A one-piece unitary plastic container comprising: a base, a side wall extending upward from the base, a shoulder portion extending upward and inward from an upper margin of the side wall to a neck portion, and a cap-receiving finish fixed to the neck portion defining a mouth of the container, the side wall including at least two horizontal rows of vacuum panels adapted to compensate for pressure changes within the container occurring subsequent to filing and capping the container, the vacuum panels in at least one of the horizontal rows having a height to width aspect ratio of less than one, each vacuum panel of the at least one horizontal row having a margin surrounding an outwardly domed central portion, the central domed portion including four rounded corner protrusions joined together by a smooth saddle shaped surface.

2. The plastic container of claim 1 wherein the vacuum panels having an aspect ratio of less than one are separated from horizontally adjacent vacuum panels by a ridge having inwardly directed side portions.

3. The plastic container of claim 2 wherein each inwardly directed portion continues around the entire margin surrounding the central portion of each vacuum panel.

4. The plastic container of claim 2 wherein the ridges separating each pair of horizontally adjacent vacuum panels includes outer surfaces forming elements of a single cylindrical surface.

5. The plastic container of claim 4 further comprising circumferential ring elements separating the horizontal rows of vacuum panels, the ring elements forming additional elements of the single cylindrical surface.

6. The plastic container of any of claims 2, 3, 4, or 5 wherein the outwardly domed central portion is formed by at least two different interior radii of different size.

7. A container made of thermoplastic material comprising: a bottom portion, a neck portion, and an intermediate body portion including at least two circumferential horizontal rows of vacuum panels providing for controlled volumetric reduction of the container, a land separating each horizontally adjacent pair of panels in each row, the vacuum panels in at least one of the horizontal rows having a height to width aspect ratio of less than one and including a central outwardly domed portion having four rounded corner protrusions joined together by a smooth saddle shaped surface.

8. The container of claim 7 wherein the lands separating each pair of horizontally adjacent vacuum panels comprise outer surfaces forming elements of a single cylindrical surface.

9. The container of claim 8 further comprising circumferential ring elements separating the horizontal rows of vacuum panels, the ring elements forming additional elements of the single cylindrical surface defined by the lands separating each pair of horizontally adjacent vacuum panels.

10. The container of claim 9 wherein each of the vacuum panels having an aspect ratio of less than one includes a margin recessed with respect to the single cylindrical surface, the margin surrounding the outwardly domed central portion.

11. The container of claim 10 wherein the outwardly domed central portion of each of the vacuum panels having an aspect ratio of less than one is defined by a radius that is shorter than the radius defining the single cylindrical surface.

12. A container made of thermoplastic material especially adapted for hot filling comprising: a bottom portion, a neck portion, and a generally cylindrical intermediate body portion enveloping a central vertical axis, the cylindrical intermediate body portion including at least two circumferential rows of panels including means for providing controlled volumetric reduction of the container in response to the presence of a partial vacuum within the container, a land separating each adjacent pair of panels in each row, a circumferential band separating each of the at least two circumferential rows of panels from each other, the rows of panels being staggered with respect to each other such that the lands of one row are vertically aligned with the panels of any adjacent row, the vacuum panels in at least one of the horizontal rows having a height to width aspect ratio of less than one and a central outwardly domed portion including four rounded corner protrusions joined together by a smooth saddle shaped surface.

13. The container of claim 12 wherein the central outwardly domed portion of the vacuum panels having a height to width aspect ratio of less than one is defined by a radius having a length from at least about 0.2 to about 2 times the size of the radius measured from the vertical axis to the cylindrical intermediate body portion surface.

14. The container of claim 13 wherein the central outwardly domed portion is formed by at least two different interior radii of different size.

15. A container made of thermoplastic material comprising: a bottom portion, a neck portion, and an intermediate body portion including at least two circumferential horizontal rows of vacuum panels providing for controlled volumetric reduction of the container, a land separating each horizontally adjacent pair of panels in each row, at least some of the vacuum panels having a central outwardly domed portion having four rounded corner protrusions joined together by a smooth saddle shaped surface.

16. The container of claim 15 wherein at least some of the vacuum panels have a height to width aspect ratio of less than one.

17. The container of claim 15 wherein the lands separating each pair of horizontally adjacent vacuum panels comprise outer surfaces forming elements of a single cylindrical surface.

18. The container of claim 17 further comprising circumferential ring elements separating the horizontal rows of vacuum panels, the ring elements forming additional elements of said single cylindrical surface.

19. The container of claim 17 wherein each of the vacuum panels includes a margin surrounding the central outwardly domed portion that is recessed with respect to said single cylindrical surface.

20. The container of claim 17 wherein the central outwardly domed portion of each of the vacuum panels is defined in part by a radius that is shorter than the radius defining said single cylindrical surface.

* * * * *